United States Patent [19]

Brauer

[11] 4,192,164

[45] Mar. 11, 1980

[54] ROLLING MILLS

[75] Inventor: Hans Brauer, Leichlingen, Fed. Rep. of Germany

[73] Assignee: Friedrich Kocks GmbH & Company, Dusseldorf, Fed. Rep. of Germany

[21] Appl. No.: 927,731

[22] Filed: Jul. 24, 1978

[30] Foreign Application Priority Data

Jul. 19, 1977 [DE] Fed. Rep. of Germany ..... 2732496

[51] Int. Cl.[2] ..... B21B 1/18

[52] U.S. Cl. ..... 72/234

[58] Field of Search ..... 72/234, 235, 226, 228, 72/200

[56] References Cited

U.S. PATENT DOCUMENTS

| | | | |
|---|---|---|---|
| 3,221,529 | 12/1965 | Chang | 72/237 |
| 3,355,923 | 12/1967 | Gillet | 72/234 |
| 3,382,697 | 5/1968 | Neumann | 72/226 |
| 3,383,896 | 5/1968 | Blinn | 72/226 |
| 3,930,395 | 1/1976 | Bretschneider et al. | 72/228 |

FOREIGN PATENT DOCUMENTS

| | | | |
|---|---|---|---|
| 1213692 | 11/1959 | France | 72/226 |

*Primary Examiner*—Milton S. Mehr

*Attorney, Agent, or Firm*—Buell, Blenko & Ziesenheim

[57] ABSTRACT

A rolling mill and method for single strand rolling of bar sections is provided having a plurality of successive in-line roughing roll stands on a pass line in which the last two roughing roll stands are radially adjustable transverse to the pass line to produce a rough bar having a cross section substantially the same at its finished section and a plurality of successive in-line finishing roll stands receiving the rough bar and rolling the same to finish condition.

14 Claims, No Drawings

ROLLING MILLS

This invention relates to rolling mills and particularly to a rolling mill for the single strand rolling of bar sections, such as round, hexagonal or square bars, which rolling mill has one behind the other in a straight rolling line, at least one multi-stand roughing block and/or a plurality of roughing stands for the purpose of main deformation or reduction and a finishing block for after-sizing, the cross section of the work-material beyond the last roughing stand being substantially the same as its finished cross section. The invention includes methods of operating rolling mills as well as rolling mill structures for accomplishing this purpose.

It is usually important to obtain finished products having very close dimensional tolerances and a high degree of accuracy of shape at the end of the rolling operation, particularly when rolling high-grade and high-quality steels, and also when rolling other materials. Therefore, it has been the practice to arrange one or a plurality of roll stands or a block of roll stands beyond conventional hot-rolling stands or blocks which essentially perform the reduction of the cross section, whereby only a relatively small reduction of the cross section is needed to be effected by the finishing block or finishing stands so that the dimensional accuracy and the accuracy of shape of the work-material is improved.

It is very expensive to operate rolling mills of the known type described initially, particularly when a rolling program has to be effected having a large number of relatively small runs with relatively small dimensional differences between the runs and high demands are placed on the quality and the tolerances. In such cases, frequent conversion of the rolling mill is necessary in which the existing rolls have to be removed and fresh rolls have to be fitted. The removal and fitting of the rolls, including all the incidental work involved, necessitate the plant being put out of operation for long periods of time, and thus result in a correspondingly low average output. Furthermore, a large number of rolls for the individual roll stands has to be kept available, thus resulting in considerable prime costs and storage costs. A further disadvantage of the known construction resides in the fact that the quality of the finished work-material is dependent to a high degree upon the ability and conscientiousness of the operating personnel. This also affects the length of the stoppage times when changing the dimensions.

An object of the present invention is to provide a rolling mill of the type described initially which does not have the above-mentioned disadvantages and which is particularly suitable for rolling programs involving a plurality of finely graduated dimensions, frequent changes in the dimensions of the finished commodity, close tolerances and various materials.

In the method of operating a rolling mill in accordance with the invention, the rolls of at least the two last stands in the rolling direction in front of the finishing block and/or the two last stands of roughing blocks arranged before the finishing block are adjustable radially of the run-through axis of the work-material, and the rolls of the finishing block are not adjustable, the latter being driven at constant rotational speeds which are only changed upon a change of dimension, and the entire reduction in the cross section by the finishing block does not fluctuate between more than approximately 2 and 12%, only $\frac{2}{3}$ to $\frac{3}{4}$ of this reduction being applicable to the prescribed or nominal reduction of the cross section and the remaining available reduction serving to compensate for cross-sectional irregularities and variations of the work material entering the finishing block, the rolling sizing passes of the finishing block having to be interchanged upon each change of dimension, and the rolling sizing passes of the roughing stands or roughing blocks only having to be changed when a change of cross sectional area exceeding approximately 8 to 15% is contemplated.

This means, in particular, that all the rolls of all the roll stands of the rolling mill do not have to be changed every time the nominal dimension of the work material is changed and, in most cases, it is only necessary to change or recondition the relatively few rolls of the finishing block. This is rendered possible by virtue of the fact that, upon a change of dimensions between runs, the required change of cross section, within a change of area of up to approximately 15%, of the work-material entering the finishing block can be obtained without changing the rolls in the roughing stands or roughing blocks and merely by adjusting the rolls in these stands or in some of them. It is only necessary to change the rolls of the roughing stands or roughing blocks when the said range of area change is exceeded. However, since this is necessary far less frequently than in the known rolling mills, the rolling mill in accordance with the invention can be operated substantially more economically. For a rolling program of runs comprising, for example, 120 different cross-sectional dimensions and/or shapes, the rolls of the roughing stand or roughing stands only have to be changed or reconditioned approximately 20 times when using the rolling mill in accordance with the invention. This not only constitutes a considerable saving of time and labor for the changing of the rolls, but also substantially reduces the down times of the rolling mill. This means that the rolling mill in accordance with the invention has a correspondingly greater output and is more suitable for frequent changes of dimensions between runs and thus for a rolling program having a plurality of finely graduated dimensions, and for frequent changes of work-material.

A further substantial advantage resides in the very small number of rolls which have to be kept available, so that this also constitutes a considerable saving of costs. Furthermore, owing to the fact that fewer rolls have to be changed and the roll stands of the finishing block are not adjustable, one is significantly less dependent upon the ability and the attentiveness of the operating personnel than in the case of a known rolling mill. Furthermore, the adjustability of at least some of the roll stands in advance of the finishing block renders it possible to produce a commodity having a very close range of tolerance and high accuracy of shape, so that irregularities remaining on the entry side of the finishing block are so slight that the finishing block can virtually fully eliminate them. This leads to a particularly high quality of the finished cross section of the commodity. This is attributable to the fact that the predetermined reduction of the cross section in the finishing block amounts to only $\frac{2}{3}$ to $\frac{3}{4}$ of the reduction in the cross section which the finishing block is capable of effecting, while the remaining third to quarter of the reduction of the cross section is available for compensating for the wide variety of cross-sectional irregularities. Cross-sectional irregularities of this type can occur as a result of temperature changes, wear on the rolls, irregularities in the shape and dimensions of the new material, and with respect to the material which can broaden in a manner different from that intended. Thickened ends can also be largely compensated for in this manner.

Although the invention is chiefly intended for a rolling mill for the rolling of round, hexagonal or square bars, it is, fundamentally, also possible to use the same principle in a rolling mill for the rolling of other cross sections. In such a case, of course, the above-mentioned advantages would not necessarily apply to the same extent, and the numerical data would have to be correspondingly corrected. Furthermore, it is basically possible to use fewer than three stands for the purpose of after-sizing, although this would have the disadvantage that tolerances would be less satisfactorily compensated for in the case of irregularities.

In a preferred embodiment of the invention, at least the stands of the finishing block are arranged along the rolling axis on a changeover and trolley so that, without appreciable loss of time, the finishing stands can be exchanged for substitute stands mounted on a second changeover trolley. This further reduces the down time during change of dimensions between runs and correspondingly improves the economy of operation of the rolling mill. It is then advisable, during the rolling operation to recondition the roll contours of the sizing passes of the roll stands removed from the rolling line, particularly the finishing block, without removing the rolls from the stands, so that the rolls can be used again.

Furthermore, it is advantageous to keep at least the stands of the finishing block at operating temperature during machining and when they are in their stand-by positions. Thus, undesirable and unintentional changes in the sizing pass and in its position relative to the rolling axis as a result of temperature fluctuations can be largely avoided in this manner, thereby further improving the quality of the commodity. It is advantageous to maintain the temperature of the stands by circulating heated lubricant through their lubricating system.

In a preferred embodiment of the invention, the finishing block and/or the roughing stands or roughing blocks have three-roll sizing passes. Sizing passes comprising three rolls have significantly better deformation properties than, for example, two-roll sizing passes, so that even less easily deformable high-grade and high-quality steels can still be satisfactorily rolled at a relatively high rolling speed. The improved deformation properties limit the heating of the work-material during rolling, so that rolling can be effected at higher speeds than in the case of two-roll sizing passes of equal size. Furthermore, the undesirable broadening is reduced in favor of the desired elongation.

In accordance with a further feature of the invention, all the stands of the finishing block are driven by a common motor by way of fixed transmmission stages. A drive of this type involves no problems and is less expensive to manufacture and has a greater degree of operational reliability.

In general, it is advisable to provide work-material slings of regulatable size between the roughing stands or roughing blocks, and to exert a slight tensile force stressing the work-material between the last stand in the rolling direction in front of the finishing block and the first stand of the finishing block. It is thus ensured that no axial pressure is exerted on the work-material between the last stand of the roughing block or the last roughing stand on the one hand and the finishing block on the other hand. Basically, it would also be possible to form a work-material sling in front of the finishing block, although this is less advisable owing to the high run-through speed of the work-material prevailing in this region.

In the foregoing specification, I have set out certain preferred practices and embodiments of my invention, however, it will be understood that this invention may be otherwise embodied within the scope of the following claims.

I claim:

1. A rolling mill for the single-strand rolling of bar sections which rolling mill has successively one behind the other in a straight rolling line at least one multi-stand roughing block for the purpose of main deformation and a finishing block for after-sizing, the cross section of the work-material beyond the last roughing stand being substantially the same as its finished cross section, in which the rolls of at least the two last stands before the entry end of the finishing block are adjustable radially of the run-through axis of the work-material, and the rolls of the finishing block are not adjustable, the latter being provided with driving means for driving the rolls at speeds which do not change during a given run but which may be changed upon a change of dimensions between runs, and in which the entire reduction in the cross section in the finishing block does not fluctuate between more than approximately 2 and 12%, only $\frac{2}{3}$ to $\frac{3}{4}$ of this reduction being applicable to the nominal reduction of the cross section, and the remaining available reduction serving to compensate for cross-sectional irregularities, and the rolling sizing passes of the finishing block are interchanged upon each change of shape and/or dimension between runs whereas the rolling sizing passes of the roughing stands or roughing blocks only having to be changed upon a change of area exceeding approximately 8% to 15% between runs.

2. A rolling mill as claimed in claim 1 having a single roughing block in front of the finishing block.

3. A rolling mill as claimed in claim 1 having a plurality of roughing blocks ahead of the finishing blocks.

4. A rolling mill as claimed in claims 1 or 2 or 3 in which at least the stands of the finishing block in the rolling line are arranged on an exchange trolley and, without appreciable loss of time, are exchangeable for replacement stands mounted on a second exchange trolley.

5. A rolling mill as claimed in claim 4, in which, during the rolling operation, the contours of the sizing passes of the roller stands removed from the rolling line, particularly the finishing block, are reconditioned for subsequent rolling without removing the rollers from the stands.

6. A rolling mill as claimed in claim 5 in which at least the stands of the finishing block are maintained at operating temperature during machining and when in their stand-by positions.

7. A rolling mill as claimed in claim 6, having a conventional circulating lubricating system in which heated lubricant is circulating through the lubricating system of the stand-by stands for keeping the stands hot.

8. A rolling mill as claimed in claim 7 in which the finishing stand has at least three stands or sizing passes.

9. A rolling mill as claimed in claim 8 in which at least one of the finishing block and the roughing stands or roughing blocks have three-roller sizing passes.

10. A rolling mill as claimed in claim 9 in which all the stands of the finishing block are driven by a common motor by way of fixed transmission stages.

11. A rolling mill as claimed in claim 10 in which work-material slings of variable size are provided between the roughing stands or roughing blocks while a slight tensile force stressing the work-material is exerted between the last stand before the finishing block and the first stand of the finishing block.

12. The method of rolling bar sections comprising the steps of:

(a) passing a billet to be rolled to a bar through a plurality of successive in-line roll stands corresponding to conventional roughing and finishing stands in which the two last stands are adjustable radially of the run-through axis of the work material to produce a bar having approximately its finished cross section, and (b) passing the resulting bar through a plurality of successive in-line non-adjustable finishing rolls.

13. A method as claimed in claim 12 wherein the last two roll stands of the roughing roll stands are adjusted to produce a rough bar having approximately its finished cross-section.

14. A method as claimed in claims 12 or 13 wherein the finishing rolls are operated at constant speed throughout each roll run.

* * * * *